United States Patent [19]

Cheng

[11] Patent Number: 5,007,673

[45] Date of Patent: Apr. 16, 1991

[54] COLLAPSIBLE TABLE AND CHAIR SET

[76] Inventor: Yen-Feng Cheng, 5F, No. 64, Chien-Kang St., Shih-Lin District, Taipei City, Taiwan

[21] Appl. No.: 567,118

[22] Filed: Aug. 13, 1990

[51] Int. Cl.[5] ..... A47B 39/00

[52] U.S. Cl. ..... 297/159; 297/157

[58] Field of Search ..... 297/157, 159, 147

[56] References Cited

U.S. PATENT DOCUMENTS

| | | | |
|---|---|---|---|
| 555,887 | 3/1896 | Richmond | 297/159 |
| 2,949,154 | 8/1960 | Homme | 297/159 X |
| 3,099,481 | 7/1963 | Bue | 297/159 |
| 4,960,303 | 10/1990 | York | 257/159 |

*Primary Examiner*—Peter A. Aschenbrenner

[57] ABSTRACT

A collapsible table and chair set includes a base platform, a driving motor driving a main transmission shaft rotating a master bevel gear rotatably mounted in a central portion of the platform, a reel having a wire rope wound on the reel and driven by the motor for rotating the reel to wind the rope of which an upper rope end is hanged on a wall for vertically erecting a folded table and a chair set, a table and a plurality of chairs radially disposed about the table pivotably supported by a plurality of links which are driven by a plurality of worms radially disposed on the platform and driven by the master bevel gear for raising the links for extending the table and the chairs, or for lowering the links for folding the same.

6 Claims, 4 Drawing Sheets

COLLAPSIBLE TABLE AND CHAIR SET

BACKGROUND OF THE INVENTION In a tiny room of a crowded apartment, the fixed table and chair provided in the room may occupy a large volume influencing living activities. In a crowded city such as Tokyo, Japan or Hong Kong, the housing is quite expensive so that the people having no higher income may only have a small house for accommodating an individual or a family. In such a small house or room, it is expected to invent a collapsible table and chair set which can be extended for dining, drinking or playing card purposes, and may be folded and erected for saving space.

SUMMARY OF THE INVENTION

The object of the present invention is to provide a table and chair set supported by collapsible linkage in which the table and plural chairs can be extended for use, and when not in use a controller is actuated to fold the table and chairs and to vertically erect the folded table and chairs for saving space to be comfortable for living activities.

DETAILED DESCRIPTION

Figure 1:
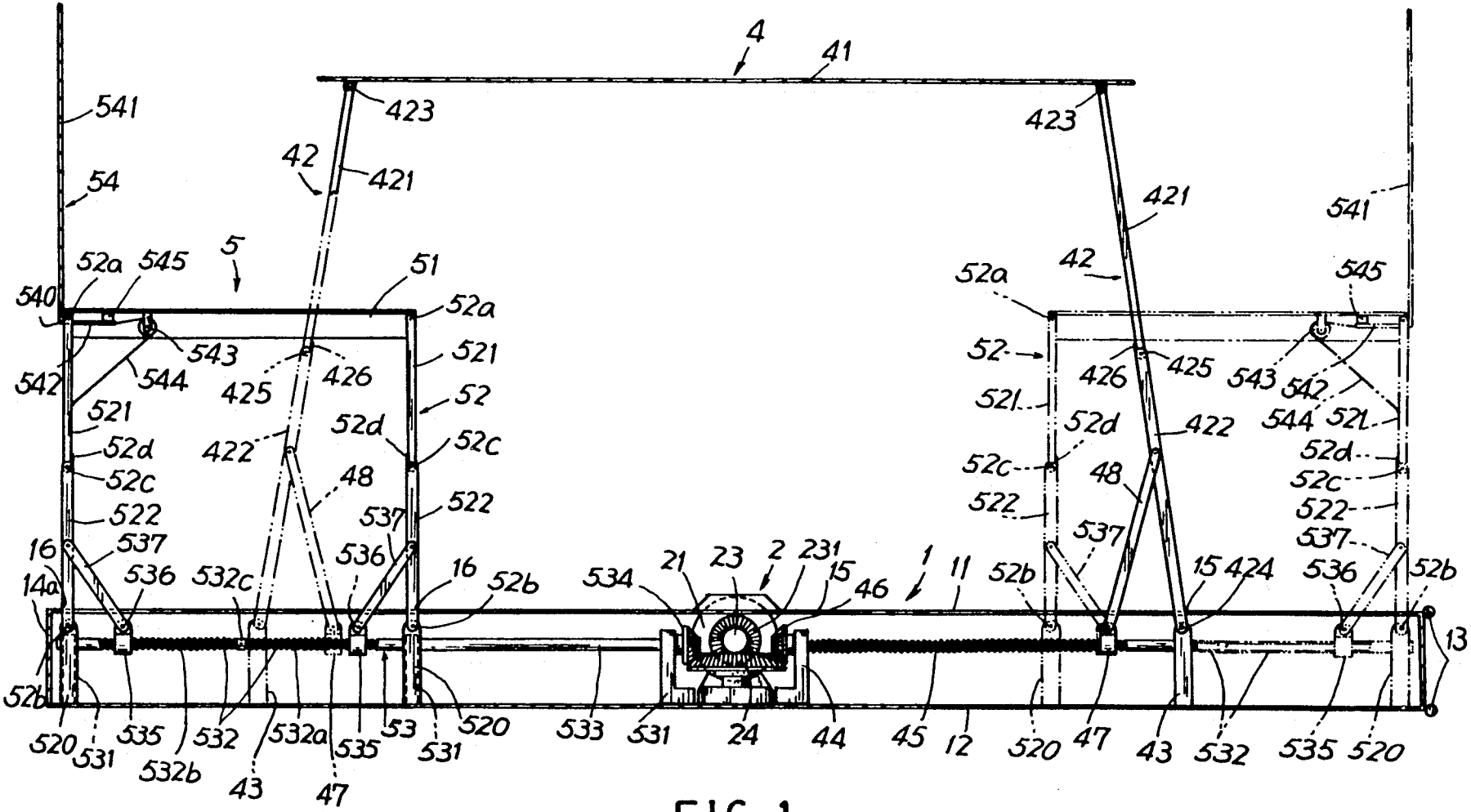
FIG. 1 is a front elevational view of the present invention.
Figure 2:
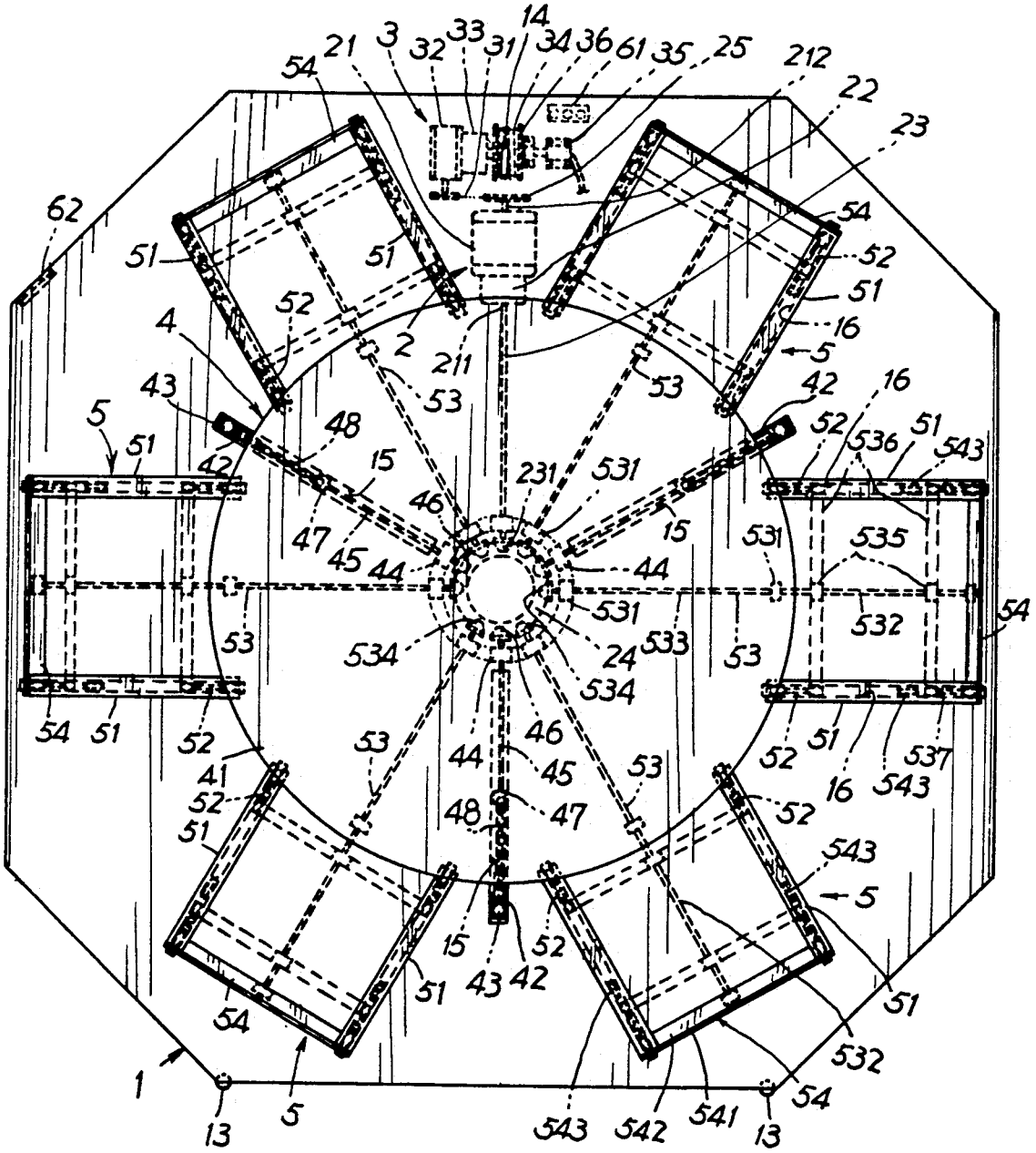
FIG. 2 is a top view illustration of the present invention.

As shown in the figures, the present invention comprises: a base platform 1, a driving means 2, an erection and lay-down means 3, a table 4, a plurality of chairs 5, and a control means 6.

The base platform 1 includes an upper plate 11, a lower plate 12, and a side wall plate 14 securing the upper plate 11 and the lower plate 12 and a plurality of supporting rollers 13 formed on a side portion of the side wall plate 14*a* approximate to a wall W.

The driving means 2 includes a driving motor 21 mounted on the lower plate 12 of the base platform 1, having an inner motor shaft 211 connected with a main transmission shaft 23 as coupled by a clutch 22 and having an outer shaft 212 coupled to a speed-reducing means 32 through a transmission belt 31. The main transmission shaft 23 has its inner bevel gear 231 coupled with a master bevel gear 24 pivotally formed in a central portion of the base platform 1. The motor 21 can be forwardly rotated or reversely rotated and can be operated at reduced speed.

Figure 7:
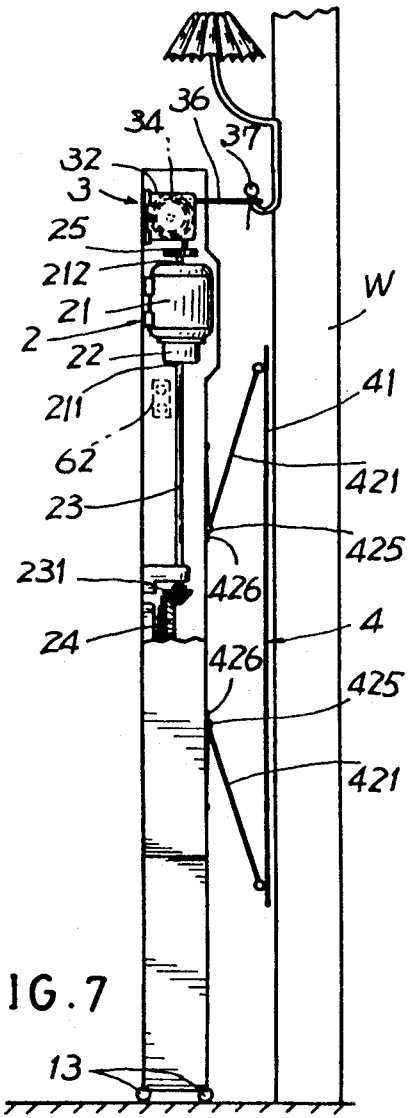
FIG. 7 shows a vertically erected folded table and chair set of the present invention.
Figure 6:
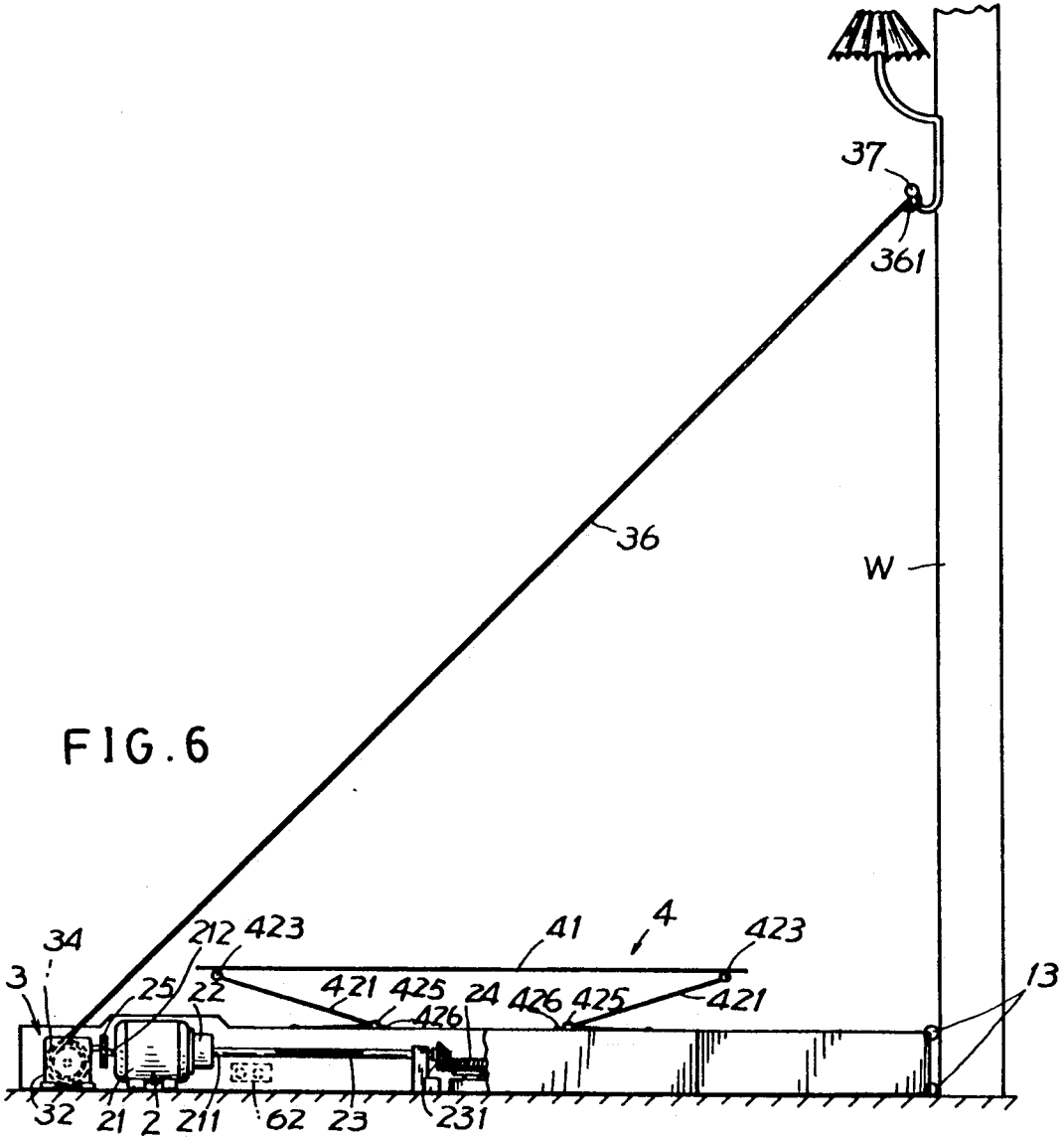
FIG. 6 shows a lay-down table and chair set of the present invention ready for erecting operation.

A speed-reducing means 32 of the erection and lay-down means 3 is connected to a reel 34 by means of clutch 33 having a wire rope 36 wound on the reel 34. The wire rope 36 includes a loop 361 formed on its outer end to be hanged on a hook 37 secured on a wall W as shown in FIG. 6. The reel 34 is rotated to wind the rope 36 thereon in order to erect the folded table and chair set vertically as shown in FIG. 7 and can be stopped by a brake device 35 for braking the rotating reel 34. The rope 36 is passing through a slot 14 formed in the upper plate 11.

Figure 3:
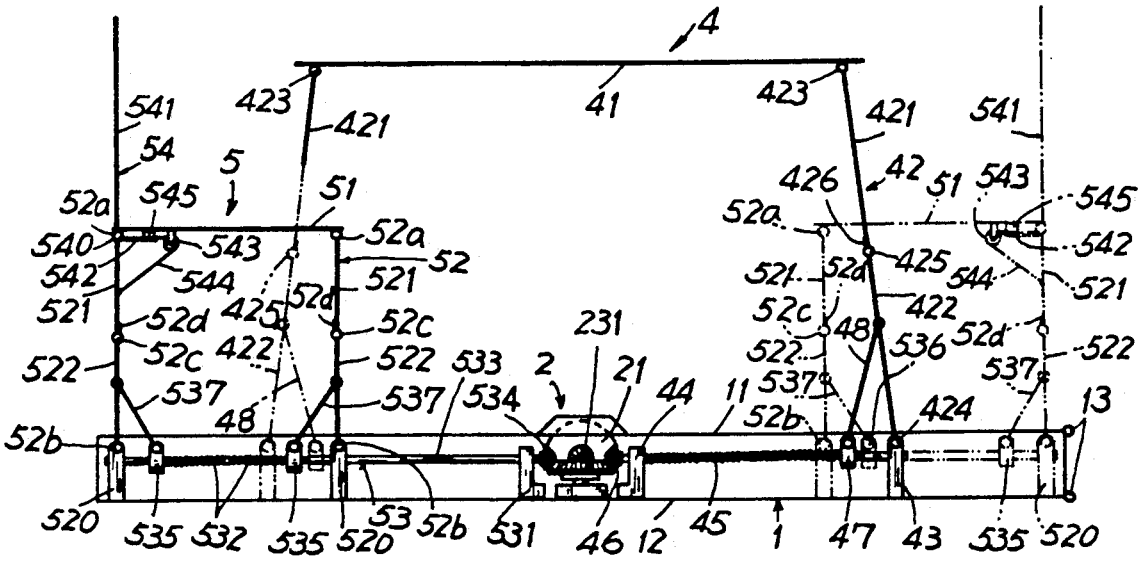
FIG. 3 shows an extended table and chair set in accordance with the present invention as simplified from FIG. 1.
Figure 4:
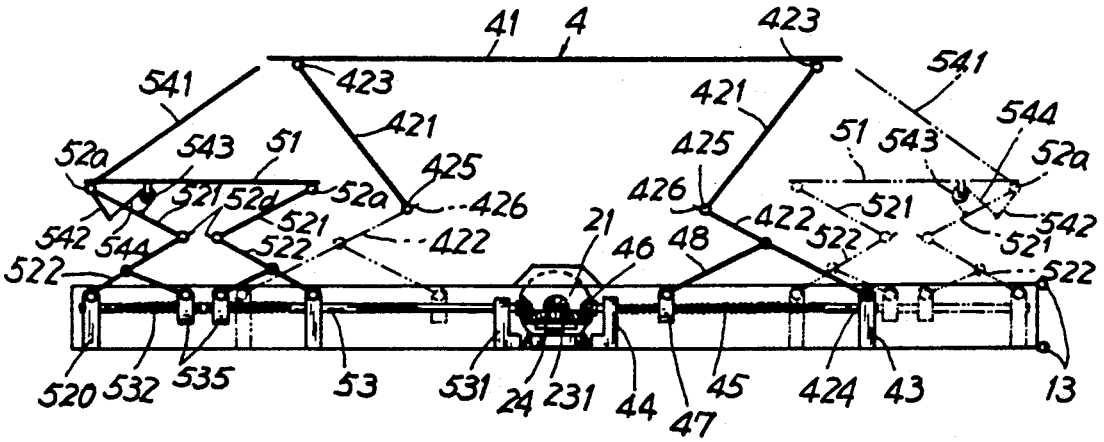
FIG. 4 shows a folding table and chair set from its extended state of the present invention.

The table 4 includes a table plate 41 pivotally secured with a plurality of linkages 42 each linkage 42 having an upper link 421 pivotally connected with a lower link 422 pivotally supported on a bracket 43 fixed on the lower plate 12 of the base platform 1, a plurality of table worms 45 each worm 45 rotatably mounted on an inner bracket 44 provided with bearing therein and the outer bracket 43 having an inner bevel gear 46 engageable with the master bevel gear 24 of the driving means 2, a table sleeve 47 having worm gear engageable with the worm 45, and a plurality of supporting links 48 each having its lower end pivotably connected with the sleeve 47 and having its upper end pivotally connected with the lower link 422. The upper link 421 is pivotally connected with the lower link 422 at pivotal joint 425, and is pivotally secured with the table plate 41 at pivotal joint 423. The lower link 422 is connected with the bracket 43 at pivotal joint 424. On the inner upper portion of the lower link 422, a limiting plate 426 is protruded upwardly from the upper inner end portion of the link 422 for stably retaining the extending operation of the linkage 42 as shown in FIGS. 4, 3. Each link 422 and link 48 are passing through a slot 15 formed the upper plate 11.

Each chair 5 radially disposed around the table 4 includes a pair of seat bars 51 for upholstery use such as for forming a cushioning seat thereon, four linking legs 52 pivotally securing the two seat bars 51 so that each seat bar 51 is pivotally connected with two legs 52, a two-way worm 53 and a chair back 54. Each linking leg 52 includes an upper chair link 521 pivotally secured to each bar 51 by pivotal joint 52*a*, and a lower chair link 522 pivotally connected with the upper link 521 pivotal joint 52*c* and pivotally supported on a bottom bracket 520 fixed on the lower plate 12 a pivotal joint 52*b*. The lower link 522 is passing through slot 16 in plate 11. The four linking legs 52 are symmetrically connected with the two bars 51 at a generally square shape from a top view of the chair 5. The two-way worm 53 includes a rod 533 rotatably mounted on the bearing brackets 531, one male-threaded worm portion 532 formed on an outer portion of the rod 533 having an inner rightwardly-threaded worm portion 532*a* and an outer leftwardly-threaded worm portion 532*b*, and inner bevel gear 534 engageable with the master bevel gear 24 of the driving means 2, two chair sleeves 535 each sleeve 535 having female-threaded hole formed therein hole respectively engageable with the two threaded worm portion 532*a*, 532*b* of the worm 53, two transverse rods 536 each transversely secured with each of the two sleeves 535 formed on an inner portion or an outer portion of each chair 5, and four chair supporting links 537 each link 537 pivotally secured between each rod 536 and each lower link 522. Each link 522 is passed through a slot 16 formed in the upper plate 11. A limiting plate 52*d* is protruded upwardly from an upper inner end portion of the lower link 522 for stably retaining an extended link 52 as shown in FIGS. 3, 4. The transverse rod 536 is slidably held in a pair of guide grooves formed in the platform 1 (not shown).

The chair back 54 generally shaped as L shape of is longitudinal section includes a vertical plate 541 and a horizontal plate 542, having a right-angle boundary portion 540 formed between plates 541, 542 pivotally mounted on each outer lower end portion of the seat bars 51, two rollers 543 rotatably formed under the bars 51 each wound with a wire 544 of which one wire end is secured to the horizontal plate 542 and the other wire end secured to the upper link 521 near the back 54. When extending the links 52 to raise the chair 5, the wire 544 is tensioned to pull the horizontal plate 542 upwardly along roller 543 as shown in FIGS. 4, 3 to vertically erect the vertical plate 541 of the back 54 for backing use. For serving as buffer for the raising plate 542, an elastomer pad 545 is provided on the plate 542 to be sandwiched between the bar 51 and the plate 542.

The control means 6 includes a first selector switch 61 of multiple push buttons or selectors for operatively selecting an extension or a retraction of the table 4 and chairs 5, and a second selector switch 62 formed on the side wall 14*a* for operatively erecting or laying down the folded table and chair set. The second switch 62 may be depressed only after the first switch 61 has been first depressed to a folded position. All slots 15, 14, 16 should be made of dust proof.

When using the present invention to extend the table 4 and chairs 5, the "extension" push button or selector of the first selector switch 61 is depressed to start a forward running of motor 21 and couple the shaft 211 with transmission shaft 23 to rotate the master gear 24 and all bevel gears 46, 534. The forward rotation of motor 21 and worm 45 will move the sleeves 47 radially outwardly to raise each supporting link 48, link 42 and the table plate 41 from an inner recessed linkage towards a vertical linkage (FIGS. 5, 4, 3) so as to extend the table 4. Meanwhile, each chair worm 53 is forwardly rotated to inwardly push the sleeve 535 and 536 on the rightwardly-threaded worm portion 532*a*, and to outwardly push the sleeve 535 and rod 536 on the leftwardly-threaded worm portion 532*b* from a junction portion 532*c* of the threaded portion 532 so as to raise the links 537, 52, bars 51 in order to raise the chair 5. The raising of link 521 will pull the wire 544 to raise the back 54 to be vertically erected as shown in FIGS. 3, 1.

Figure 5:
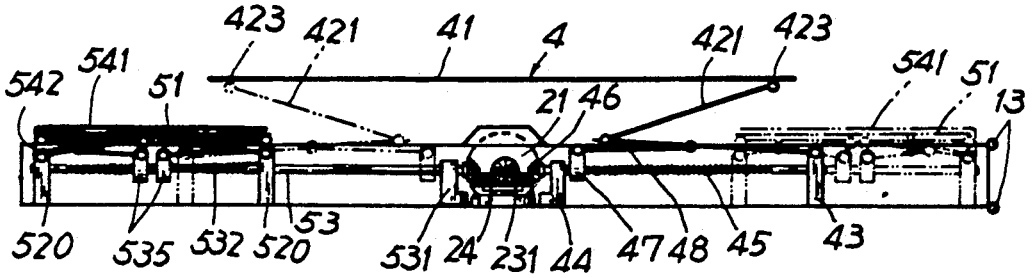
FIG. 5 shows a folded table and chairs set of the present invention.

When retracting the table 4 and chairs 5, the retraction button or selector is depressed to inversely rotate the motor 21, worms 45, 53 to lower the links 42, 52 so as to fold the table 4 and chairs 5 as shown in FIG. 5. When pulling the loop 361 outwardly to actuate a specific push-buttom or selector of the first switch 61, the clutch 22 is uncoupled and the brake 35 of reel 34 is unlocked and the wire rope 36 can then be pulled upwardly to be hanged on the hook 37. By depressing the erecting operation of the second switch 62, the clutch 33 is coupled with reel 34 and the wire rop 36 will be wound onto the reel 34 upon the rotation of motor 21 so as to erect the folded table and chair set as shown in FIG. 7. The rollers 13 will serve as fulcrum when erecting the folded table and chair set. After erecting the folded table and chair set, the brake 35 will be actuated to stop the running motor and reel 34. The table and chair set is now vertically erected and folded for saving space, beneficial for any interior activities. For laying down the present invention, a "lay-down" selector or push button of the second switch 62 is depressed to unlock the brake 35 and the motor 21 is reversely rotated to unwind the wire rope 36 on the reel 34 so as to lay down the present invention which is then further operated by depressing the first switch 61 for extending the table and chairs for dining or seating purpose. The wire rope 36 will be automatically wound onto the reel 34 by removing its upper loop 361 from the hook 37 by a restoring spring formed in the reel 34. When laying down the folded table and chair set from its erected state, the roller 13 can be pushed towards the wall W to serve as a fulcrum for laying down operation.

I claim:

1. A collapsible table and chair set comprising:

a base platform;

a driving means including a driving motor operatively rotatable forwardly or reversely, a main transmission shaft coupled to an inner shaft of the driving motor, a master bevel gear rotatably mounted in a central portion of said base platform driven by said main transmission shaft driven by said driving motor;

an erection and lay-down means including a reel operatively coupled to and driven by an outer shaft of said driving motor, a wire rope having an inner end portion wound on said reel and an outer end portion formed as a loop adapted to be hung on a hook fixed on a wall;

a table including a table plate and a plurality of linkages pivotally secured under the table plate and secured on said platform, a plurality of table worms radially rotatably mounted on said platform and operatively driven by said master bevel gear and said driving motor, and a plurality of table sleeves each having worm gear engageable with each said table worm and having a supporting link pivotally secured between said sleeve and said linkage for operatively raising said linkage for extending the table, or lowering said linkage for folding the table;

a plurality of chairs radially disposed around said table each said chair including a pair of seat bars pivotally connected with a plurality of linking legs pivotally secured to said platform, a two-way chair worm radially and rotatably mounted on the platform and operatively engageable with and driven by said master bevel gear and said driving motor, each said two-way worm having a rightwardly-threaded worm portion engageable with a chair sleeve secured with a transverse rod which is pivotably connected with two inner chair supporting links pivotally connected to a pair of inner linking legs formed on an inner portion of the chair, and a leftwardly-threaded worm portion engageable with another chair sleeve secured with another transverse rod which is pivotally connected with two outer chair supporting links pivotally connected to a pair of outer linking legs formed on an outer portion of the chair; and a control means having a first selector switch for operatively extending or retracting a table and chair set, and a second selector switch for operatively erecting a folded table and chair set or laying down the table and chair set, whereby upon a forward rotation of said driving motor and said master bevel gear, said worms will be forwardly rotated to radially move said sleeves for raising said linkages and linking legs for upwardly extending the table and chairs;

and whereby upon a rotation of the reel, the wire rope can be receivably wound on the reel from a lower end portion of the wire rope to erect a folded table and chair set when an upper end portion of the wire rope is hanged on a wall and the table and chair set is folded.

2. A collapsible table and chair set according to claim 1, wherein said table includes said linkage having an upper link pivotally connected with a lower link, said lower link having a limiting plate protruding upwardly from an upper inner end portion of said lower link for stably retaining an extended linkage of said table.

3. A collapsible table and chair set according to claim 1, wherein said chair includes said linking leg having an upper chair link pivotally connected with a lower chair link having a limiting plate formed on an upper inner end portion of said lower chair link for stably retaining the linking leg of said chair when extended.

4. A collapsible table and chair set according to claim 1, wherein said chair further includes a chair back generally L-shaped of its longitudinal section, having a vertical plate and a horizontal plate secured with a wire wound on a roller formed under each said seat bar, said wire secured to an upper chair link, a junction portion between the vertical plate and the horizontal plate pivotally connected to an outer lower end portion of each said seat bar, wherein upon a raising of the chair linking leg, the upper chair link will pull the wire and the horizontal plate to bias the junction portion to vertically erect the vertical plate for backing purpose when extending the chair.

5. A collapsible table and chair set according claim 1, wherein said two-way worm includes an inner chair sleeve formed with female-threaded hole engageable with the inner rightwardly-threaded worm portion of the two-way worm and an outer chair sleeve formed with another female-threaded hole engageable with the outer leftwardly-threaded worm portion, whereby upon a forward rotation of said two-way worm as driven by said driving motor, said two sleeves will respectively move inwardly and outwardly from a junction portion between the rightwardly-threaded worm portion and the leftwardly-threaded worm portion for raising the links of the chair.

6. A collapsible table and chair set according to claim 1, wherein said base platform includes an upper plate, a lower plate for mounting said links, said motor, said gears and said worms and a side wall plate secured between the upper and lower plates having at least a supporting roller rotatably formed on a side portion of the side wall plate approximate to a wall serving as a fulcrum when erecting the folded table and chair set along the wire rope having an upper end portion of the wire rope hung on the hook fixed on the wall.

* * * * *